US006501428B1

(12) United States Patent
Blom et al.

(10) Patent No.: US 6,501,428 B1
(45) Date of Patent: Dec. 31, 2002

(54) ANTENNA DEVICE FOR DUAL FREQUENCY BANDS

(75) Inventors: Carl-Gustav Blom, Lysekil (SE); Martin Jensen, Kalmar (SE); Henrik Lindkvist, Lund (SE)

(73) Assignee: Moteco AB, Ruda (SE)

( * ) Notice: Subject to any disclaimer, the term of this patent is extended or adjusted under 35 U.S.C. 154(b) by 0 days.

(21) Appl. No.: 09/628,682

(22) Filed: Jul. 28, 2000

Related U.S. Application Data

(63) Continuation of application No. PCT/SE99/00035, filed on Jan. 14, 1999.

(30) Foreign Application Priority Data

Jan. 30, 1998 (SE) ..... 9800290

(51) Int. Cl.[7] ..... H01Q 1/24; H01Q 1/36
(52) U.S. Cl. ..... 343/702; 343/895
(58) Field of Search ..... 343/702, 895, 343/725, 729, 900, 901; H01Q 1/24, 1/36

(56) References Cited

U.S. PATENT DOCUMENTS

| | | | | |
|---|---|---|---|---|
| 4,730,195 A | | 3/1988 | Phillips et al. | |
| 5,479,178 A | | 12/1995 | Ha | 343/702 |
| 5,764,191 A | | 6/1998 | Tsuda | 343/702 |
| 5,771,023 A | | 6/1998 | Engblom | 343/702 |
| 5,825,330 A | | 10/1998 | Na et al. | 343/702 |
| 5,859,617 A | | 1/1999 | Fujikawa | 343/702 |
| 5,969,684 A | | 10/1999 | Oh et al. | 343/702 |
| 5,999,142 A | * | 12/1999 | Jang | 343/834 |
| 6,018,321 A | | 1/2000 | Simmons et al. | 343/702 |
| 6,075,489 A | | 6/2000 | Sullivan | 343/702 |
| 6,204,818 B1 | | 3/2001 | Chang et al. | 343/702 |
| 6,239,768 B1 | | 5/2001 | Oh et al. | 343/895 |
| 6,246,372 B1 | | 6/2001 | Egawa et al. | 343/702 |
| 6,255,996 B1 | * | 7/2001 | Wallace | 343/702 |
| 6,262,693 B1 | * | 7/2001 | Sutter et al. | 343/895 |

FOREIGN PATENT DOCUMENTS

| | | |
|---|---|---|
| EP | 0 790 666 A1 | 8/1997 |
| GB | 2 206 243 A | 12/1988 |
| WO | WO 95/12224 | 5/1995 |
| WO | WO 99/26315 | 5/1999 |

OTHER PUBLICATIONS

Copy of International Search Report for the related PCT parent application.

* cited by examiner

*Primary Examiner*—Hoanganh Le
(74) *Attorney, Agent, or Firm*—Smith, Gambrell & Russell

(57) ABSTRACT

An antenna device for a radio communications apparatus operates in at least a first frequency band and a second frequency band. This antenna device includes a helical first antenna element for the first frequency band, wherein the helical antenna element has a supply end galvanically connectable to circuits of the radio communications apparatus. The antenna device also includes a second, substantially rod-shaped antenna element for the second frequency band. This second antenna element is disposed along and outside the helical antenna element. The rod-shaped antenna element has, in a region of the supply end of the helical antenna element, a supply portion which, at least partly and at a distance, surrounds an outer circumferential surface of the helical antenna element or its extension away from the helical antenna element. The antenna device may also include a third, substantially rod-shaped antenna element galvanically connectable to the supply portion. When two rod-shaped antenna elements present, preferably they are located on opposite sides of the helical antenna element, and more preferably, approximately diametrically opposed to one anther.

31 Claims, 3 Drawing Sheets

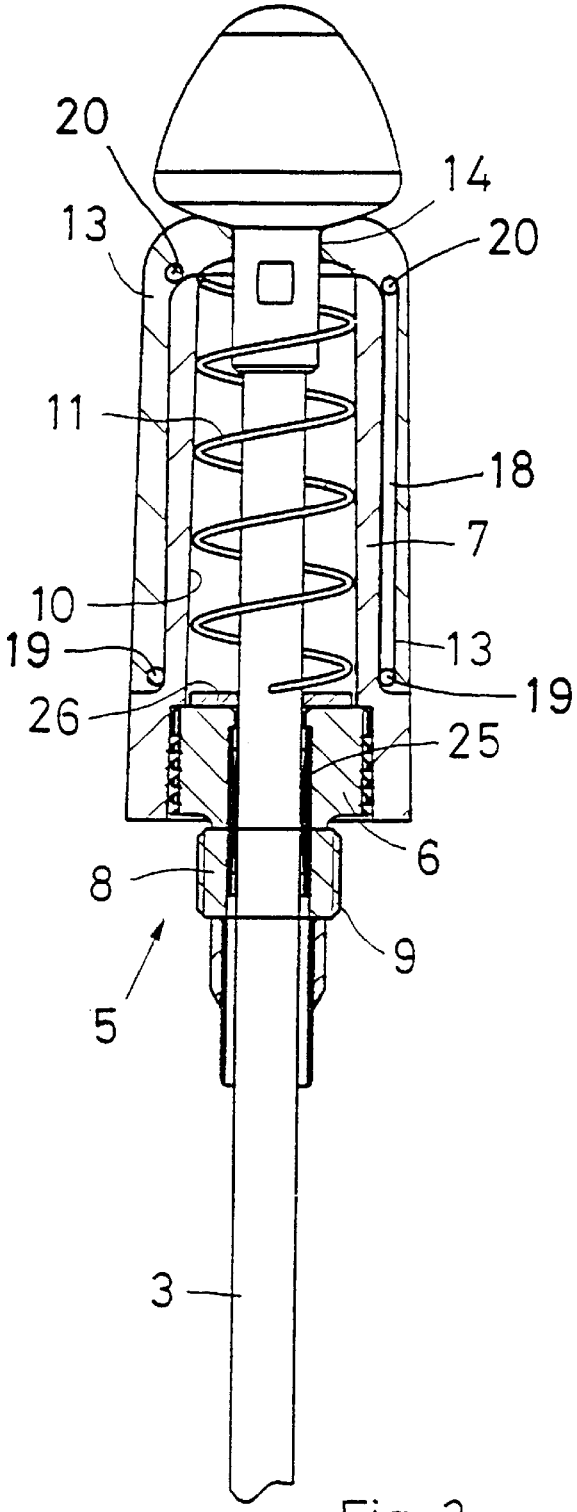
Fig 3
Fig 4
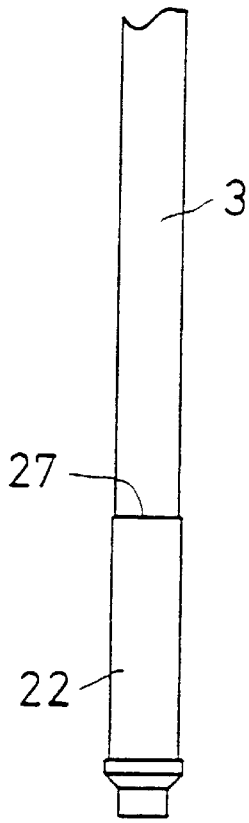
Fig 5
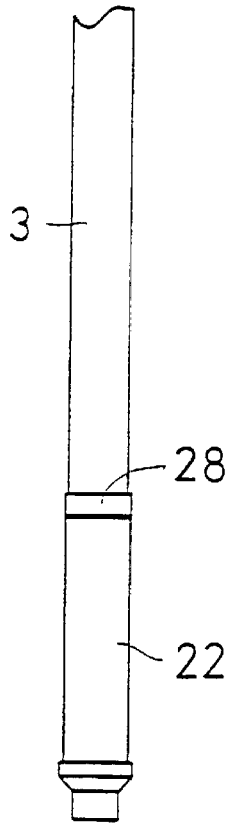

ANTENNA DEVICE FOR DUAL FREQUENCY BANDS

RELATED APPLICATION DATA

This application is a continuation of PCT Patent Appln. No. PCT/SE99/00035, filed Jan. 14, 1999, which application claims priority to Swedish Patent Appln. No. 9800290-0, filed in Sweden on Jan. 30, 1998. Each of these two priority applications is entirely incorporated herein by reference.

TECHNICAL FIELD

The present invention relates to an antenna device for a radio communications apparatus operating in at least two frequency bands, and comprising a helical first antenna element for the one frequency band, the helical antenna element having a supply end galvanically connected to the circuits of the radio communications apparatus, and a second, substantially rod-shaped antenna element for the second frequency band, the second antenna element being disposed along and outside the helical antenna element.

BACKGROUND ART

In radio communications apparatuses, in daily parlance mobile telephones, use is often made of different antennae for different operational states in the apparatus. In the standby state of the apparatus, paging mode, use is made of an antenna where one of the most important requirements is compact physical dimensions.

Mobile telephones operate within different frequency bands, for example approx. 450 MHz in the NMT band, approx. 900 MHz in the GSM band and approx. 1800 MHz in the DCS band. There are also mobile telephones in existence which are designed to be able to operate in more than one frequency band, and in such constructions antenna capacity is required in both of the frequency bands. Mobile telephones with three different frequency bands may also become topical.

Mobile telephones are previously known in the art possessing a plurality of antennae and in which the switching between these antennae takes place with the aid of mechanical switches. To employ switches in addition for switching between different frequency bands is hardly feasible in such small compact antenna which are employed in the standby state, the paging mode.

PROBLEM STRUCTURE

The present invention has for its object to design the antenna device intimated by way of introduction such that it may be produced with extremely compact dimensions and may be caused to operate in more than one frequency band without the employment of mechanical or other switches. The present invention further has for its object to design the antenna device in such a manner that it may be manufactured simply and economically at the same time as displaying good mechanical strength.

SOLUTION

The objects forming the basis of the present invention will be attained if the antenna device intimated by way of introduction is characterized in that the rod-shaped antenna element has, in the region of the supply end of the helical antenna element, a supply portion which, at least partly and at a distance, surrounds the outer circumferential surface of the helical antenna element or its extension away from the helical antenna element.

Further advantages will be attained according to the present invention if the device according to the invention is also given one or more of the characterizing features as set forth in appended subclaims 2 to 7.

BRIEF DESCRIPTION OF THE ACCOMPANYING DRAWINGS

The present invention will now be described in greater detail hereinbelow, with particular reference to the accompanying Drawings. In the accompanying Drawings:

FIG. 3 is a section through an upper portion of the antenna device of FIG. 2;

FIG. 4 shows a lower portion of the antenna device of FIG. 2;

FIG. 5 shows a modified embodiment of the lower portion according to FIG. 4;

DESCRIPTION OF PREFERRED EMBODIMENT

The present invention will be described as forming part of an antenna device which, in addition to the antenna element for standby position, paging mode, also includes an antenna element for talk position. The antenna device in which the subject matter of the present invention is included is therefore a complete dual-band antenna which is switchable between paging mode and talk position.

Figure 1:
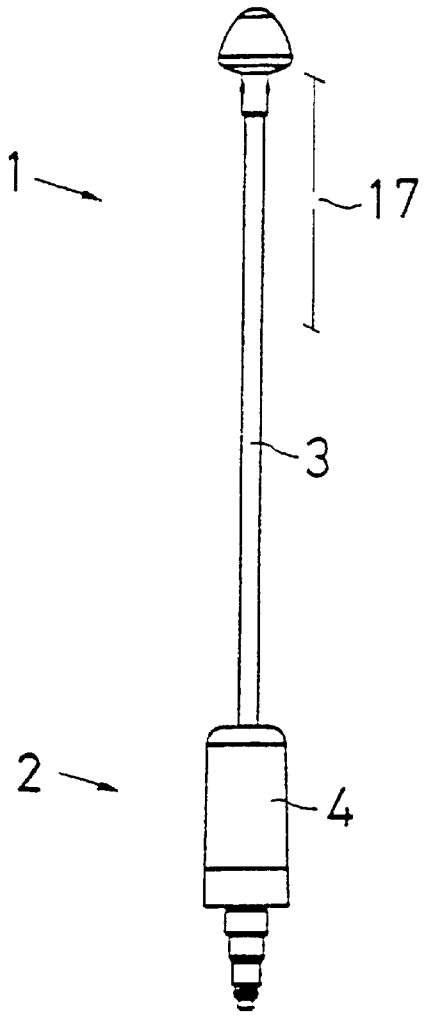
FIG. 1 shows a complete, dual-band antenna device intended for a mobile telephone (not shown), where the antenna device is switchable between a standby position, paging mode, and a talk position.
Figure 2:
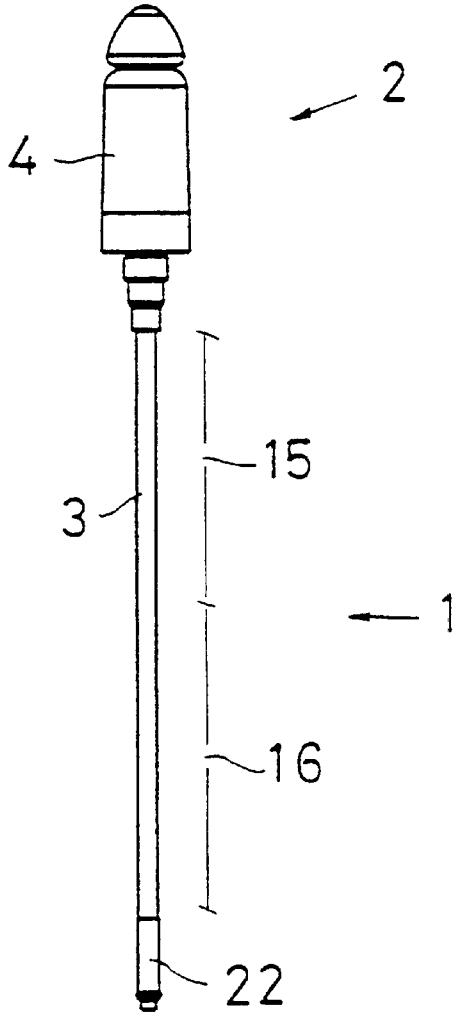
FIG. 2 shows the antenna device of FIG. 1 in the standby position.

From FIGS. 1 and 2 taken together, it will be apparent that the antenna device includes a first antenna unit which is designed as a rod arrangement 3, and a second antenna unit 2 which is at least partly designed as a helical arrangement 4. Both the rod arrangement 3 and the helical arrangement 4 are designed to operate in at least two frequency bands without the use of switches. The helical arrangement 4 is further secured in the radio communications apparatus, in daily parlance a mobile telephone, which the antenna arrangement is intended to serve.

The first antenna unit 1 is of dual-band design in order simultaneously to be capable of operating within the both frequency bands for which the mobile telephone is operative. At the same time, it should be interpreted in this context such that both transmission and reception may take place in two frequency bands simultaneously; on the other hand, transmission in one frequency band and reception in another frequency band will cause problems. Correspondingly, the second antenna unit 2 is also of dual-band design for the same frequency bands as the first antenna unit. The first antenna unit is intended for the talk position of the mobile telephone, while the second antenna unit 2 is intended for the paging mode of the mobile telephone. Switching between talk position and paging mode is realised by the displacement of the first antenna unit 1 in its longitudinal direction through the second antenna unit 2 between the two states, as shown in FIGS. 1 and 2. It should be observed that, in the state for paging mode (FIG. 2), it is only the second antenna unit 2 which is visible on the outside of the outer casing of the mobile telephone.

The antenna device includes means for electric switching between paging mode and talk position, and the switching between these states is realised by the above-mentioned displacement movement of the first antenna unit 1.

The means for switching between talk position and paging mode may include either an electric switching device or a device for bringing either of the antenna unit to a resonance state which is located a safe distance outside the selected frequency bands when the relevant antenna unit is not be used.

The antenna device further includes means for coupling both of the antenna units 1 and 2 to the relevant frequency bands. Such means are designed in such a manner that there is no mechanical switching device included. Instead, switching between the frequency bands is realised in that radiating antenna elements included in the antenna units are connected capacitatively or inductively.

FIG. 3 shows a section through the helical arrangement 4 and an upper portion of the rod arrangement 3 extending therethrough. It will be apparent from the Figure that the antenna device is constructed around a bushing member 5 produced from metal and intended for securing of the antenna device in a casing (not shown) for a mobile telephone. The bushing member 5, which is galvanically connected to the circuits of the mobile telephone, has a central, through-going channel for accommodating the rod arrangement 3, and also an upper, substantially cylindrical portion 6 on which is disposed a tubular carrier member 7 produced from electrically insulating material. The carrier member 7 is secured on the upper, cylindrical portion 6 in that this is provided with circumferential barbs, rifling or threads which engage in the material of the carrier member 7 which suitably is an at least somewhat resiliently yieldable or semi-hard plastic material. The cylindrical bushing member 5 further displays a lower portion 8 with a thread 9 which serves for securing the antenna device in the mobile telephone.

The carrier member 7 has a central, substantially cylindrical channel 10 which is open in the upper end of the carrier member. Interiorly in the channel 10 of the carrier member 7, there is disposed a first antenna element 11 which is designed as a helix. The first antenna element is set for the lower frequency band of the antenna device and is galvanically connectable to the electric circuits of the mobile telephone. The galvanic connection exists in paging mode, while it may possibly be discontinued in talk position.

The helix 11 is resilient and axially compressible within the channel 10. The upper end of the helix rests against an abutment at the upper end of the channel 10, while the lower end of the helix rests on a washer 26 on the bushing member 5. Otherwise, the helix is loosely disposed in the channel.

On the outside of the carrier member 7, possibly countersunk in its outer circumferential surface, but possibly completely inside in this surface, there is disposed a second antenna element 12 which substantially has the form of a rod antenna. The second antenna element 12 is set for the higher frequency band and is galvanically discrete from the first antenna element 11, the, bushing member 5 and from the electric circuits of the mobile telephone.

As is apparent from FIG. 3, the second antenna element 12 has a rod member 18 which is disposed outside the first antenna element 11, i.e. the helix, along it and approximately parallel with its centre axis. In the lower end, the rod member 18 has a supply portion 19 which is in the form of an annular formation which is disposed on the outside of the outer circumferential surface of the helix 11. The supply portion may suitably be of one piece manufacture with the rod member and is disposed at the lower end of the helix 11, i.e. its supply end, which is galvanically connected to the circuits of the mobile telephone via the bushing member 5.

The supply portion 19 is, as was mentioned previously, annular and may extend in the circumferential direction from substantially one full turn to a considerably smaller circumferential angle about the helix 11. The supply portion 19 lies substantially in a plane which is at right angles to the centre axis of the helix. Further, the vertical position of the supply portion 19, i.e. the position along the axis of the helix, may vary from an upper position approximately in accordance with FIG. 3 or possibly somewhat higher, to a lower position where the supply portion 19 is located about the cylindrical portion 6 of the bushing member 5.

The coupling of the second antenna element 12 to the circuits of the mobile telephone is put into effect capacitatively between the supply portion 19 and the lower end of the helix 11 or the cylindrical portion 6 of the bushing member 5, or combinations thereof. Depending on the circumferential angle for the supply portion 19, this capacitative coupling will be more or less "hard", where a hard degree of coupling, i.e. large circumferential angle of the supply portion, imparts a more narrow-banded function to the first antenna element 11, while greater band-width facility is achieved if the circumferential angle of the supply portion 19 is reduced, or alternatively if the distance from the supply portion 19 to the helix or the cylindrical portion 6 is increased, i.e. the coupling capacity is reduced.

Naturally, a certain scatter capacitance occurs between the rod member 18 of the second antenna element 12 and the helix 11, but this scatter capacitance contributes to but an insignificant degree in the coupling between the two antenna elements 11 and 12.

To reduce the physical length of the rod member 18 at a certain given frequency, the rod member 18 has, in its upper end, a top section 20 designed as a "halo" which is an annular formation lying in a plane which is transversely directed to the longitudinal direction of the rod member 18 which is approximately parallel to the plane of the supply portion 19. Both the top section 20 and the supply portion 19 are, as is apparent from FIG. 6, open, i.e. they are not completely dosed rings. The circumferential angle of the top section 20 may also vary from the large value illustrated in FIG. 6 close to a complete turn and to a considerably smaller circumferential angle.

With the setting frequencies, i.e. 900 MHz and 1800 MHz, it is possible to make the second antenna element 12 with approximately the same axial extent, i.e. physical length, as the helix 11. This embodiment is also illustrated in FIG. 3.

Figure 6:
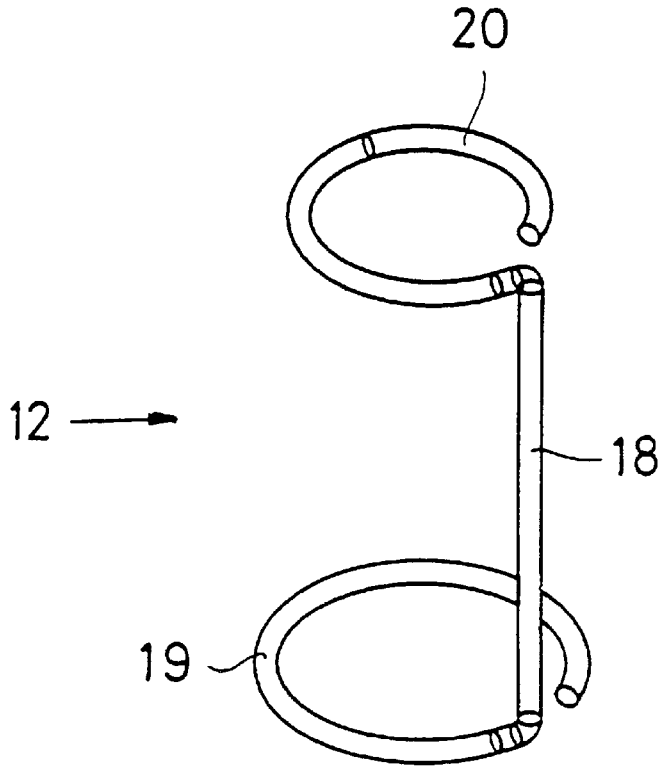
FIG. 6 is a perspective view of the second antenna element.
Figure 7:
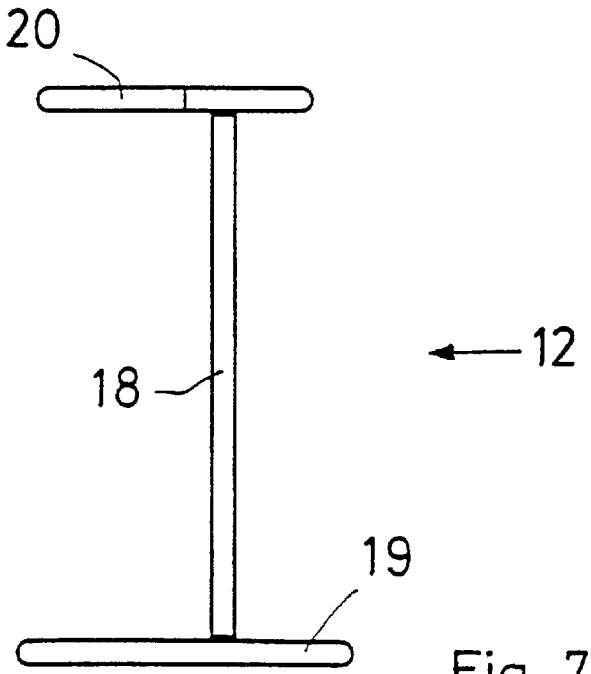
FIG. 7 is a vertical plan view of the second antenna element.

In one antenna device which is designed to operate with three different frequency bands, it is possible to provide, to the supply portion 19 illustrated in FIG. 6, an additional rod member which should then be located approximately diametrically opposed the rod member 18.

Electrically, the helix arrangement 4 functions as follows. The first antenna element 11, i.e. the helix disposed interiorly in the carrier member 7, is galvanically connected to the circuits of the mobile telephone via a metal washer 26 which rests on the upper cylindrical portion 6 of the bushing member 5. When the antenna element 11 is supplied with or receives electromagnetic radiation within the lower frequency band, this radiation will pass the second (i.e. the outer) antenna element 12, without being influenced to any great extent thereby, since the outer antenna element 12 has a resonance frequency at a safe distance from the resonance frequency of the inner antenna element 11, and further because it is so "scanty" that it has no appreciable screening effect.

The second antenna 12 is set to the higher frequency band. If transmission takes place within this higher frequency band, the second antenna element 12 will function as a radiating element which is capacitatively coupled to the lower end of the inner helix 11, the washer 26 or the cylindrical portion 6, or a combination thereof. Correspondingly, on reception within the higher frequency band, a capacitative coupling will occur such that received energy is transmitted to the circuits of the apparatus.

If the placing of the two antenna elements 11 and 12 were the reverse compared with that shown on the Drawing, such that the helix 11 were placed outermost, the function of the device would deteriorate seriously, since the outer helix in this case would function as an effective screen for the antenna element 12 lying inside.

It will be apparent from the foregoing that the antenna device according to the present invention functions, in the standby position, or paging mode, of the mobile telephone without the use of any mechanical switching arrangement between the two antenna elements 11 and 12. Further, the antenna element for the lower frequency band may, during paging mode, be permanently and galvanically connected to the circuits of the mobile telephone.

As was mentioned above, the complete antenna device includes, in addition to the helix arrangement 4, also a rod arrangement 3. This is shown but schematically on the Drawings.

In FIG. 1, it is intimated that the rod arrangement 3 has an upper portion 17 which is produced from electrically insulating and non-magnetic material. The longitudinal extent of this upper portion 17 is such that, when the antenna device is located in the position according to FIG. 2, the upper portion 17 should, in the longitudinal direction, fill out at least the helix arrangement 4 and its lower mounting and connecting parts. The reason for this is that, in the paging mode, FIG. 2, where the helix arrangement 4 is in operation, there may not be any electrically conductive or magnetic material located interiorly in the helix arrangement 4 without seriously disrupting its function.

The rod arrangement 3 further has a third antenna element 15, for the greater part intended for the lower frequency band, and a fourth antenna element 16, for the greater part intended for the higher frequency band.

In its lower end, the rod arrangement 3 has a metal sleeve 22 via which it is supplied electrically. The upper end of the metal sleeve 22 has a projecting edge 27, in the embodiment according to FIG. 5 disposed on a plastic ring 28, which is included in the means for switching the antenna device between the paging mode and talk position.

In the foregoing, a detailed description of the helix arrangement 4 was given and a brief description of the rod arrangement 3, separately both electrically and mechanically. With reference to FIG. 3, it will now be disclosed how the cooperation between them takes place.

The bushing member 5 has, as was mentioned above, a through-going channel through which the rod arrangement 3 is displaceable in its longitudinal direction. In order to prevent play and give the desired electric contact, there are disposed interiorly in the bushing member 5, metallic spring elements 25 which slide along the insulating surface coating of the rod arrangement 3 when the rod arrangement is displaced. In the protracted position of the rod arrangement, in the talk position as shown in FIG. 1, the bushing member 5 with its spring elements 25 achieve electric contact with the lower contact sleeve 22 of the rod arrangement, whereby the rod arrangement becomes directly galvanically coupled to the circuits of the mobile telephone.

In the position of the rod arrangement according to FIG. 2, i.e. in the paging mode, the lower end of the inner helix 11 rests on an electrically conductive washer 26 which in its turn rests on the upper side of the cylindrical upper portion 6 of the bushing member 5. Hereby, electric galvanic connection prevails between the bushing member and the lower end of the helix 11. In this position, the spring elements 25 rest on the insulating outer casing of the rod arrangement, for which reason the rod arrangement is disconnected from the circuits of the mobile telephone.

On protraction of the rod arrangement from the position shown in FIG. 2 to the position shown in FIG. 1, the rod arrangement will slide through the helix arrangement 4 until a projecting edge region 27 (FIGS. 4 and 5) on the upper end of the metal sleeve 22 comes into abutment against the lower side of the washer 26. On continued lifting, the washer 26 will accompany the rod arrangement 3 in its upward movement, whereby the helix 11 is compressed in the axial direction. The helix 11 is, granted, still galvanically coupled to the electric circuits of the mobile telephone but will, as a result of this axial compression, first have a misadaptation (set to lower resonance frequency) concerning the frequency, and thereafter will wholly cease to exist as a radiating antenna element. Hereby, the outer antenna element 12 will naturally also be electrically disconnected to the extent the coupling takes place with the lower end of the lower end of the helix 11 and the washer 26. If, on the other hand, the supply portion 19 substantially couples to the cylindrical portion 6, the outer antenna element 12 is still coupled-in when the rod arrangement 3 is in operation in the higher frequency band. On the other hand, on operation in the lower frequency band, the antenna element 12 is misadapted, for which reason it does not function.

In one alternative embodiment, it is possible to place, on the upper end of the metallic sleeve 22 on the lower end of the rod arrangement 3, a ring 28 of insulating material On protraction of the rod arrangement 3, the ring 28 will come into abutment against the washer 26 and lift this out of electric contact with the bushing member 5. Hereby, the helix 11 will be electrically disconnected from the circuits of the mobile telephone as soon as the washer 26 has been lifted out of electric contact with the bushing member 5.

In one practical embodiment, the outer antenna element 12 is set to the DCS band. In this band, the outer antenna element 12, i.e. the rod member 18, has an axial length of approx. 13 mm, while both the supply portion 19 and the top section 20 are open and have a circumferential angle in the proximity of 360°. Further, the distance between the supply portion 19 and the washer 26 on the cylindrical portion 6 is of the order of magnitude of 2–3 mm. The radial distance in to the helix 11 is approx. 2 mm. Correspondingly, the inner helix 11 is set to the GSM band and has a diameter of approx. 5 mm, a pitch of approx. 3 mm and approx. 5 turns. The wire gauge of the supply portion is approx. 0–5 to 0.6 mm.

The present invention may be modified further without departing from the scope of the appended Claims.

What is claimed is:

1. An antenna device for a radio communications apparatus operating in at least a first frequency band and a second frequency band, the antenna device comprising: a helical first antenna element for the first frequency band, the helical antenna element having a supply end galvanically connected to circuits of the radio communications apparatus, and a second, substantially rod-shaped antenna element for the second frequency band, the second antenna element being disposed along and outside the helical-antenna element, wherein the rod-shaped antenna element has, in a region of the supply end of the helical antenna element, a supply portion which, at least partly and at a distance, surrounds an outer circumferential surface of the helical antenna element or its extension away from the helical antenna element.

2. The antenna device as claimed in claim 1, further comprising a third, substantially rod-shaped antenna element galvanically connected to the supply portion.

3. The antenna device as claimed in claim 2, wherein the two rod-shaped antenna elements are located on opposite sides of the helical antenna element.

4. The antenna device as claimed in claim 3, wherein each of the rod-shaped antenna elements is galvanically discrete from the helical antenna element.

5. The antenna device as claimed in claim 4, wherein at least one of the rod-shaped antenna elements has a top section formed as a loop whose plane is substantially parallel with a plane for the supply portion.

6. The antenna device as claimed in claim 5, wherein each of the rod-shaped antenna elements has its top section located in a region of an end of the helical antenna element away from the supply portion.

7. The antenna device as claimed in claim 4, wherein each of the rod-shaped antenna elements has its top section located in a region of an end of the helical antenna element away from the supply portion.

8. The antenna device as claimed in claim 3, wherein at least one of the rod-shaped antenna elements has a top section formed as a loop whose plane is substantially parallel with a plane for the supply portion.

9. The antenna device as claimed in claim 8, wherein each of the rod-shaped antenna elements has its top section located in a region of an end of the helical antenna element away from the supply portion.

10. The antenna device as claimed in claim 3, wherein each of the rod-shaped antenna elements has its top section located in a region of an end of the helical antenna element away from the supply portion.

11. The antenna device as claimed in claim 2, wherein each rod-shaped antenna has its top section located in a region of an end of the helical antenna element away from the supply portion.

12. The antenna device as claimed in claim 2, wherein each of the rod-shaped antenna elements is galvanically discrete from the helical antenna element.

13. The antenna device as claimed in claim 12, wherein at least one of the rod-shaped antenna elements has a top section formed as a loop whose plane is substantially parallel with a plane for the supply portion.

14. The antenna device as claimed in claim 13, wherein each of the rod-shaped antenna elements has its top section located in a region of an end of the helical antenna element away from the supply portion.

15. The antenna device as claimed in claim 12, wherein each of the rod-shaped antenna elements has its top section located in a region of an end of the helical antenna element away from the supply portion.

16. The antenna device as claimed in claim 2, wherein the helical antenna element is set to a lower frequency band than the rod-shaped antenna elements.

17. The antenna device as claimed in claim 16, wherein at least one of the rod-shaped antenna elements has a top section formed as a loop whose plane is substantially parallel with a plane for the supply portion.

18. The antenna device as claimed in claim 17, wherein each of the rod-shaped antenna elements has its top section located in a region of an end of the helical antenna element away from the supply portion.

19. The antenna device as claimed in claim 16, wherein each of the rod-shaped antenna elements has its top section located, in a region of an end of the helical antenna element away from the supply portion.

20. The antenna device as claimed in claim 2, wherein at least one of the rod-shaped antenna elements has a top section formed as a loop whose plane is substantially parallel with a plane for the supply portion.

21. The antenna device as claimed in claim 20, wherein each of the rod-shaped antenna elements has its top section located in a region of an end of the helical antenna element away from the supply portion.

22. The antenna device as claimed in claim 1, wherein the rod-shaped antenna element is galvanically discrete from the helical antenna element.

23. The antenna device as claimed in claim 22, wherein the rod-shaped antenna element has a top section formed as a loop whose plane is substantially parallel with a plane for the supply portion.

24. The antenna device as claimed in claim 23, wherein the rod-shaped antenna element has its top section located in a region of an end of the helical antenna element away from the supply portion.

25. The antenna device as claimed in claim 22, wherein the rod-shaped antenna element has its top section located in a region of an end of the helical antenna element away from the supply portion.

26. The antenna device as claimed in claim 1, wherein the helical antenna element is set to a lower frequency band than the rod-shaped antenna element.

27. The antenna device as claimed in claim 26, wherein the rod-shaped antenna element has a top section formed as a loop whose plane is substantially parallel with a plane for the supply portion.

28. The antenna device as claimed in claim 27, wherein the rod-shaped antenna element has its top section located in a region of an end of the helical antenna element away from the supply portion.

29. The antenna device as claimed in claim 26, wherein the rod-shaped antenna element has its top section located in a region of an end of the helical antenna element away from the supply portion.

30. The antenna device as claimed in claim 1, wherein the rod-shaped antenna element has a top section formed as a loop whose plane is substantially parallel with a plane for the supply portion.

31. The antenna device as claimed in claim 30, wherein the rod-shaped antenna element has its top section located in a region of an end of the helical antenna element away from the supply portion.

* * * * *